US005765693A

United States Patent [19]

Gnadt et al.

[11] Patent Number: 5,765,693

[45] Date of Patent: Jun. 16, 1998

[54] WRAP AROUND CARTON BLANK AND COMBINED WRAP AROUND CARTON AND CONTENTS

[75] Inventors: David Frederic Gnadt, Owings Mills; Kevin Joseph Markey, Westminster, both of Md.

[73] Assignee: Lever Brothers Company, Division of Conopco, Inc., New York, N.Y.

[21] Appl. No.: 475,148

[22] Filed: Jun. 7, 1995

[51] Int. Cl.[6] ..... B65D 5/50

[52] U.S. Cl. ..... 206/763; 206/770; 206/485; 206/590; 206/823

[58] Field of Search ..... 206/45.14, 45.19, 206/45.33, 45.34, 485, 476, 486, 581, 590, 823, 756, 763, 736, 770

[56] References Cited

U.S. PATENT DOCUMENTS

| | | | |
|---|---|---|---|
| D. 194,514 | 2/1963 | Rau . | |
| D. 217,131 | 4/1970 | Shreve et al. . | |
| D. 230,572 | 3/1974 | D'Allesio . | |
| D. 263,566 | 3/1982 | Polito et al. . | |
| D. 291,065 | 7/1987 | Pugh . | |
| 1,932,705 | 10/1933 | Menten . | |
| 3,003,620 | 10/1961 | Srofe | 206/45.14 |
| 3,157,275 | 11/1964 | Tolaas . | |
| 3,252,566 | 5/1966 | Hansen . | |
| 3,349,897 | 10/1967 | Stone | 206/45.14 |
| 3,627,115 | 12/1971 | Samalon . | |
| 3,627,116 | 12/1971 | Cooper | 206/45.33 |
| 3,642,124 | 2/1972 | Brown et al. | 206/45.33 |
| 3,658,175 | 4/1972 | Vrana . | |
| 3,767,037 | 10/1973 | Anderson . | |
| 3,812,957 | 5/1974 | Forbes . | |
| 4,146,127 | 3/1979 | Bayer . | |
| 4,191,289 | 3/1980 | Austin | 206/45.14 |
| 4,300,683 | 11/1981 | Roccaforte . | |
| 4,420,077 | 12/1983 | Roccaforte | 206/45.14 |
| 4,450,965 | 5/1984 | Paillet | 206/528 |
| 4,518,086 | 5/1985 | Roccaforte . | |
| 5,007,531 | 4/1991 | Lighten | 206/581 X |
| 5,361,907 | 11/1994 | Mohrhäuser | 206/528 |

FOREIGN PATENT DOCUMENTS

| | | | |
|---|---|---|---|
| 2235841 | of 0000 | France . | |
| 1089614 | 10/1954 | France | 206/485 |
| 768943 | 4/1961 | France | 206/485 |
| 303037 | 10/1965 | Netherlands . | |
| 393630 | 7/1933 | United Kingdom . | |
| 95/00116 | 1/1995 | WIPO . | |

*Primary Examiner*—David T. Fidei
*Attorney, Agent, or Firm*—Gerard J. McGowan, Jr.

[57] ABSTRACT

A combined wrap around carton, bottle and pouf. The package permits display of the bottle and a pouf simultaneously. The bottle is sufficiently rigid to form a portion of the support of the package. The carton includes a central panel having two ends and product receiving structures at each of its ends. In the erected carton, a first product is received within two product receiving apertures and a second product is placed behind the first one. The package is completed with shrink wrap so that the consumer can view the contents of the package.

23 Claims, 4 Drawing Sheets

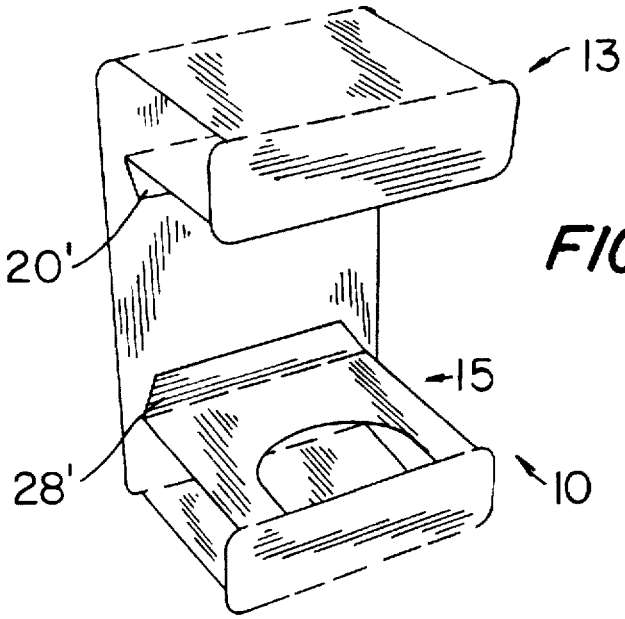
FIG. 3
FIG. 10
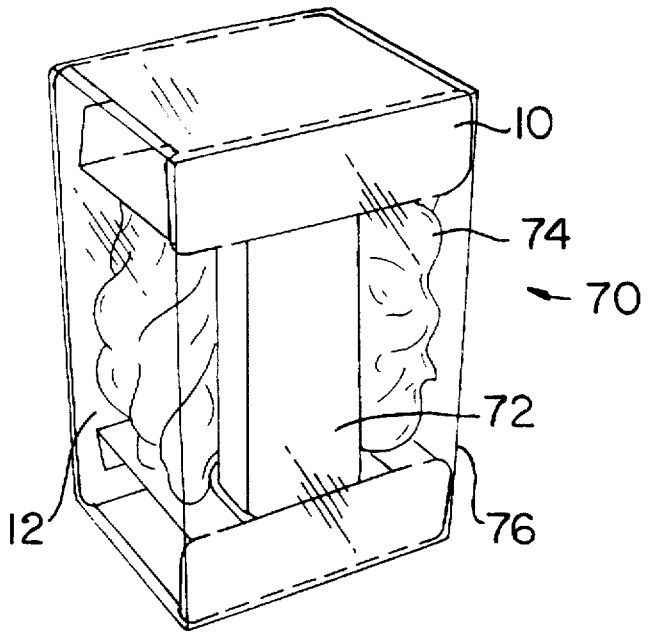

WRAP AROUND CARTON BLANK AND COMBINED WRAP AROUND CARTON AND CONTENTS

BACKGROUND OF THE INVENTION

Mechanical aids to personal washing have long been known. An example of this is the well known washcloth. Another type of washing aid is a pouf, which is made of a mesh-like plastic material. The pouf is used in association with e.g., a liquid cleansing material.

It is sometimes desirable to sell two products together. An example of this would be the sale of a liquid cleansing material together with a pouf to assist in washing. Devising a package suitable for two separate products presents a challenge to the packaging developer. One aspect of the challenge relates to the need to make both products readily and maximally visible to the consumer. A second aspect of the challenge relates to the desire to minimize packaging materials used, for environmental and cost reasons.

Bayer, U.S. Pat. No. 4,146,127 discloses a device for holding and displaying footwear having first and second footwear retaining end sections, including recessed areas adapted for the reception of portions of the footwear. The Bayer device includes a central panel and four end panels at each end of the central panel, the third end panel including an aperture for receiving the footwear. The third end panel also includes, optionally, tabs adapted to be folded to strengthen and reinforce the end structures.

NE 303037 discloses what appears to be a package having article receiving circular apertures centrally disposed in each third end panel. GB 393,630 discloses in FIGS. 1, 2, 4 and 5 racks for cutlery and the like which include apertures in product retaining structures at each end. In FIG. 2, a circular aperture is present in the middle of the third end panel.

Other display cartons in the art include ones disclaimed in Forbes, U.S. Pat. No. 3,812,957, D'Allesio, U.S. Pat. No. DES 230,572, Anderson, U.S. Pat. No. 3,767,037, Vrana, U.S. Pat. No. 3,658,175, Samalon, U.S. Pat. No. 3,627,115, Shreve et al., U.S. Pat. No. DES 217,131, Hansen, U.S. Pat. No. 3,252,566, Tolaas, U.S. Pat. No. 3,157,275, Rau, U.S. Pat. No. DES 194,514, Pugh, U.S. Pat. No. DES 291,065, Roccaforte, U.S. Pat. No. 4,518,086, Polito et al., U.S. Pat. No. DES 263,566, Roccaforte, U.S. Pat. No. 4,300,683 and FR 2,235,841.

WO 95/00116 discloses a polymeric diamond-mesh bath sponge and a liquid cleanser with moisturizer.

SUMMARY OF THE INVENTION

The invention concerns a wrap around carton which will permit display of two items such as a bottle and a pouf simultaneously. The bottle or other self supporting container, is sufficiently rigid to form a portion of the support of the package. That is, the ends of the package which retain the container need not be rigid and the container helps impart rigidity to the package. In addition, the package is preferably shrink wrapped also to provide rigidity and to keep the package in one piece.

The wrap around carton of the invention includes a central panel and product receiving structures at each end thereof. The product receiving structures include four end panels each separated from the preceding panel by a scoreline. In a preferred embodiment, the third end panel includes a product receiving aperture which is spaced from the fourth end panel. The fourth end panel is adhered to the central panel when the carton is erected. The invention also comprises a blank from which the carton may be erected.

In the erected carton, a first product is received within the two product receiving apertures. In addition, a second product may be placed behind the first product. Since the wrap around carton only obscures one side of the product, excluding the portions of the first product in the product receiving apertures, the first and second products are readily visible to the consumer. Since the package is completed with shrink wrap, the consumer can see into the package including both products. To this end preferably the central panel and most preferably the central panel and the end panels have free edges perpendicular to the transverse scorelines separating them.

At least the second end panels may be used as display panels, since they face forward in the erected panel. Consequently, it is preferred that the product receiving apertures are spaced from the second end panels. Advantageously, the product receiving apertures are disposed forwardly of the fourth end panel which is adhered to the central panel. The forward location of the self supporting container strengthens its role as a supporting member of the carton while leaving room for the second product between the self supporting container and the central panel.

Use of the wrap around carton of the invention will permit reduction in materials and therefore, reductions in costs. The first product, i.e. the self supporting container, supports the wrap around carton when shrink wrap is applied. If desired, more than one self supporting container may be used in the invention.

For a more complete understanding of the above and other features and advantages of the invention, reference should be made to the following detailed description of preferred embodiments and to the accompanying drawings.

BRIEF DESCRIPTION OF THE DRAWINGS

FIG. 3 is an alternate version of the carton of FIG. 1.

FIG. 10 is a perspective view similar to FIG. 1 except that the first and second products and the shrink wrap are also included.

DETAILED DESCRIPTION OF THE INVENTION

Figure 1:
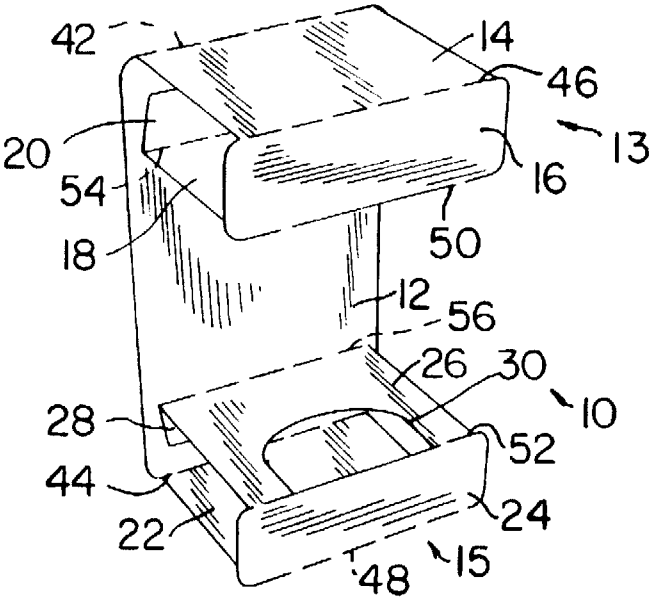
FIG. 1 is a perspective view of an erected carton according to the invention prior to addition of products or shrink wrap.
Figure 2:
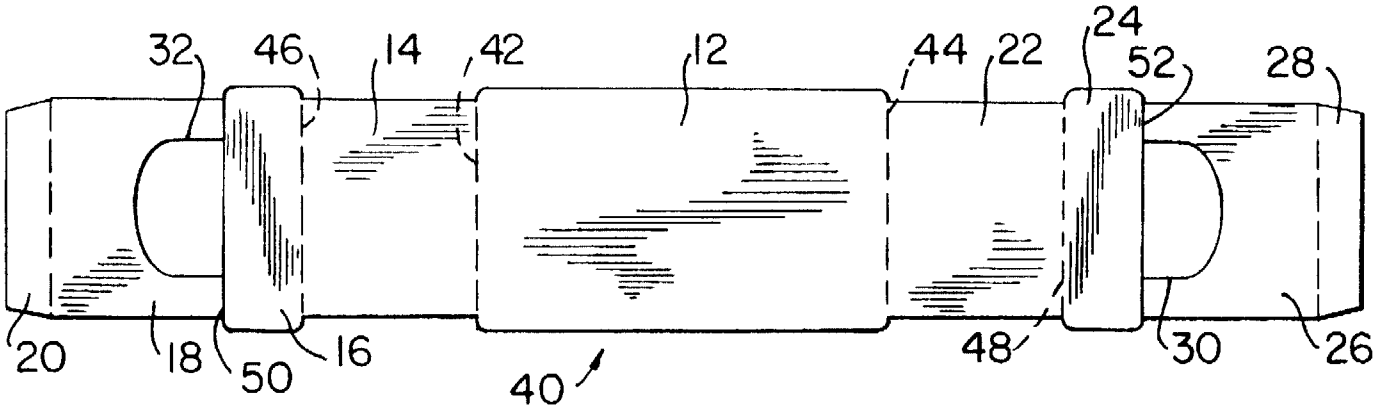
FIG. 2 is a top plan view of a carton blank which may be used to construct the carton of FIG. 1.

As best seen in FIG. 1, carton 10 of the invention comprises a central panel 12 and product receiving structures 13, 15 at each end. Structures 13, 15 comprise respectively first end panels 14, 22, second end panels 16, 24, third end panels 18, 26 and fourth end panels 20, 28. The first, second, third and fourth end panels are separated from the central panel 12 and from each other, respectively, by scorelines 42, 44; 46, 48; 50, 52; and 54, 56.

In the erected carton seen in FIG. 1, first end panels 14, 22 are disposed generally perpendicularly to central panel 12. The second end panels 16, 24 are disposed generally parallel to central panel 12 and are preferably used as display panels since they will generally face the consumer. Third end panels 18, 26 include product receiving apertures 30, 32. These apertures preferably are spaced from fourth end panels 20, 28, scorelines 54, 56 and central panel 12, as seen in FIG. 1.

Although carton 10 in FIG. 1, is shown for illustrative purposes as standing with panels 14 and 22 parallel to each other and perpendicular to panel 12, carton 10 will not normally be self-supporting and will only stand upright when combined with a self-supporting product.

Fourth end panels 20, 28 are adhered to central panel 12 with hot melt or a chemical adhesive, e.g. a water based adhesive. As seen in FIG. 1, fourth end panels 20, 28 are folded toward the product retaining structures. Alternatively, as seen in FIG. 3, end panels 20' and 28' may be folded away from the product retaining end structures 13 and 15.

As best seen in FIG. 10, wrap around carton 10 is used in package 70. Package 70 further includes a self supporting container 72, which may be a plastic or other bottle or a self supporting carton or the like. The ends of container 72 are received within product receiving apertures 30 and 32. Since container 72 is self supporting, its presence imparts structure to the carton, which need not be self supporting. Carton 10 may be made of a material such as paperboard which would not necessarily assume the structure in FIG. 1 without support, e.g. from container 72. The ends of container 72 are snugly received within product receiving apertures 30 and 32. Container 72 is contained within the perimeter of the carton.

Disposed behind container 72 is a second product, such as pouf 74. Pouf 74 comprises a plastic mesh material. Carton 10 and the products within are surrounded by shrink wrap 76. Use of shrink wrap 76 insures that the product retains its integrity and assists container 72 in supporting the product.

As can be seen e.g. FIGS. 1 and 10, the carton 10 is open on three sides; only the side facing central panel 12 is obscured. As a result, a consumer may readily see most of the contents of the package. The position of apertures 30 and 32 forward of where fourth end panels 20 and 28 are adhered to central panel 12 accommodates the inclusion of the second product, such as the pouf behind the 12 self supporting container 72. Of course, the contents of package 70 are visible behind shrink wrap 76, which is transparent.

Since package 70 is supported by the container 72 and shrink wrap 76, it does not require flaps or panels extending between end panels 14 and 18 or between end panels 26 and 22, perpendicular to the end panels and the central panel. Also, the position of the product receiving apertures distal to the central panel 12 assists the package supporting role of container 72. End panels 26 and 18 are preferably, as illustrated, not as wide as panel 12. This improves the appearance of the package when it is shrink wrapped.

A blank 40 from which carton 10 may be made is shown in FIG. 10. The carton is made by folding along the various fold lines to obtain the structure in FIG. 10 and adhering fourth end panels 20 and 28 to the central panel 12. The blank is preferably made of paperboard, corrugated board or plastic sheet.

Figure 4:
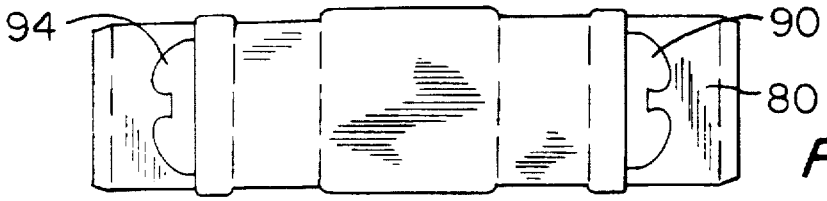
FIG. 4 is a top plan view of a blank similar to that of FIG. 2 except that two product receiving apertures are present in each end structure and the apertures are adapted for angling the two products toward each other.
Figure 5:
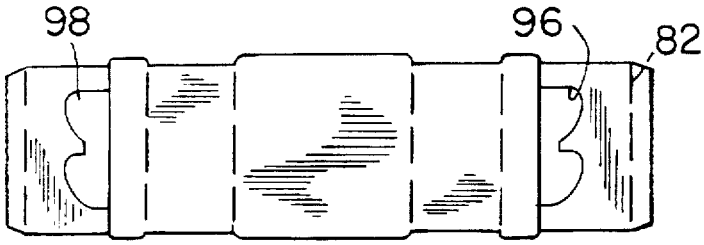
FIG. 5 is similar to FIG. 4 except that the product receiving apertures are adapted toward angling the two bottles in the same direction.
Figure 6:
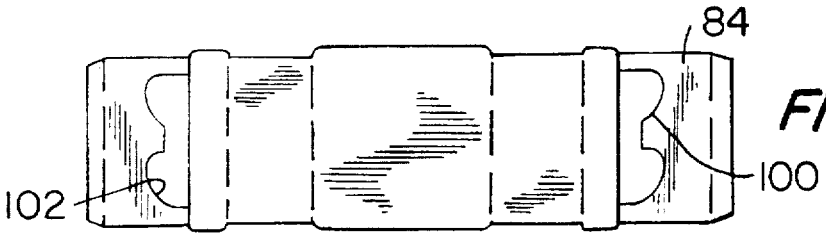
FIG. 6 is similar to FIG. 5 except that the product receiving apertures are adapted to angling the two products in the same direction but with increased space.
Figure 7:
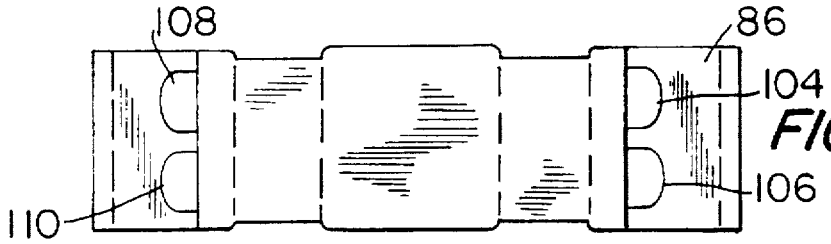
FIG. 7 is similar to FIG. 6 except that the product receiving apertures are adapted to having two products facing outwardly.

Instead of using a single self supporting container as shown in FIG. 10, the blank may be adapted for use of multiple self supporting containers, as seen in FIGS. 4–9. In FIG. 4, the blank 80 includes product retaining apertures 90 and 94 adapted to having two bottles angled toward each other, which bottles will serve as the self supporting containers. FIG. 5 is similar to FIG. 4 except that apertures 96 and 98 are adapted to having the two bottles angled in the same direction. FIG. 6 is similar to FIG. 5 except that apertures 100 and 102 are adapted to retaining two bottles angled in the same direction but with increased space between them. In FIG. 7, the apertures 104, 106, 108 and 110 are adapted to receiving two bottles facing outwardly.

Figure 8:
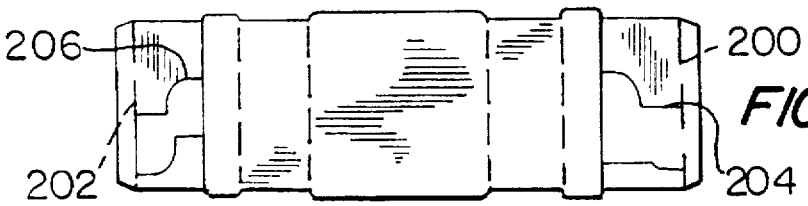
FIG. 8 is similar to FIG. 7 except that the product receiving aperture is adapted to having two bottles staggered, one in front and one in back.

FIG. 8 discloses an alternate embodiment of the invention wherein the product retaining apertures 204, 206 do extend to the scorelines 200, 202 separating the third and fourth end panels. In this embodiment one self supporting container is placed in front and one in back. The containers are staggered so that they will be readily seen by the consumer facing the display panel 16. For instance, one bottle may be placed in the left front of the package and the second bottle in the right rear of the package or the first bottle may be placed in the right front of the package and the second bottle in the left rear of the package.

Figure 9:
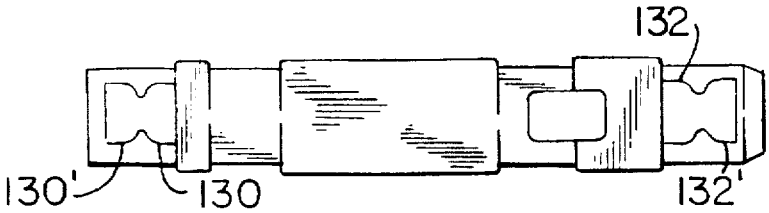
FIG. 9 is similar to FIG. 8 except that the product receiving apertures are adapted to having two bottles, one behind the other.
Figure 11:
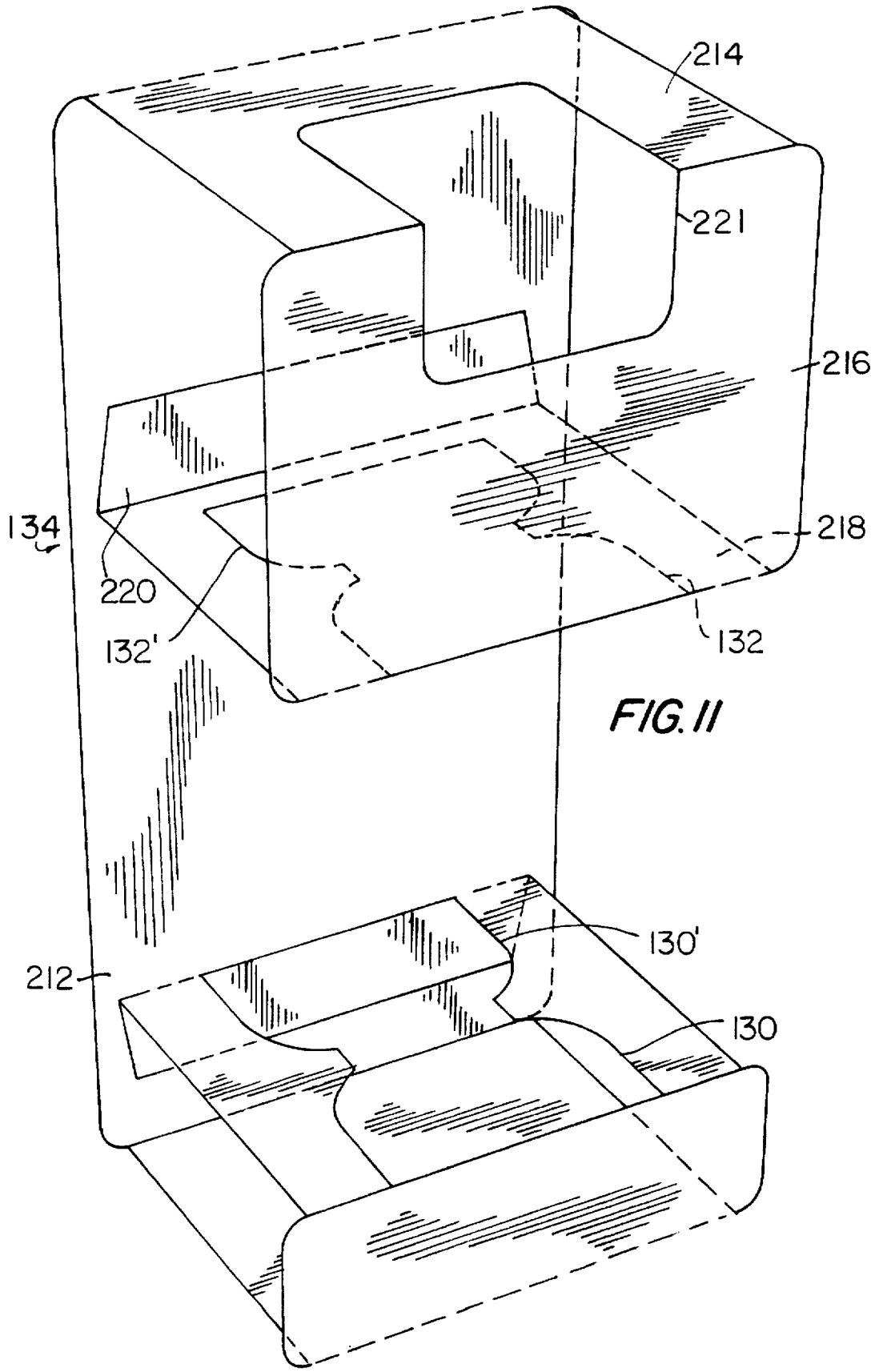
FIG. 11 is a perspective view of an erected carton constructed from the blank of FIG. 9.

FIGS. 9 and 11 show a blank and a carton, respectively, wherein two containers can be accommodated in upper and lower hourglass-shaped die cuts which form product receiving apertures 130, 132 and 130', 132'.

Each of the pairs 130, 132 and 130', 132' can receive a container. Above apertures 132, 132' a compartment 134 is formed by a portion of central panel 212, first end panel 214, second end panel 216, third end panel 218 and fourth end panel 220. A display opening 221 is cut in panels 214 and 216 so that the contents of compartment 134, e.g. a pouf, can be readily received.

It will be apparent that the package of the invention may be made of a material such as paper board which is less strong and less expensive than might otherwise be required if the design of the package did not rely on the self supporting container and the shrink wrap for support. Moreover, the package permits the consumer readily to inspect its contents. The amount of packaging material used is minimized consistent with environmental goals.

The package of the invention can utilize appreciably less paperboard than standard top and bottom tuck cartons. A reduction in paperboard area of more than 20%, especially more than 30% and preferably 40% or more can be enjoyed. The carton illustrated in FIG. 1, for instance employs 108.760 in $^2$ of paperboard as compared to 187.619 in $^2$ for a standard top and bottom tuck carton.

The pouf or sponge which is contained in the carton may, e.g. be polyethylene mesh with a cotton tie string and polypropylene tether card. The mesh may be extruded LPPE tube. Poufs are disclosed in WO 95/00116, the disclosure of which is hereby incorporated by reference.

It should be understood, of course, that the specific forms of the invention herein illustrated and described are intended to be representative only, as certain changes may be made therein without departing from the clear teaching of the disclosure. According reference should be made to the following appended claims in determining the full scope.

What is claimed is:

1. A package comprising a) a carton including i) a central panel having two ends, ii) product receiving structures at each end, each of said product receiving structures including A) a first end panel separated from said central panel by a first score line, B) a second end panel separated from said first end panel by a second score line, C) a third end panel separated from said second end panel by a scoreline, D) and a fourth end panel separated from said third end panel by a scoreline and adhered to said central panel, E) said third end panels each including a product receiving aperture spaced from said fourth end panels, said package comprising a product which is a self-supporting container received within said product-receiving apertures, said package further comprising a further product disposed between said container and said central panel, said carton being normally non-self supporting, said carton being capable of standing upright when combined with said self-supporting container.

2. The package according to claim 1 wherein the lengths of said third end panels in a direction perpendicular to said scoreline separating said second and third end panels each include a proximal third proximal to said central panel, a middle third adjacent said proximal third and a distal third distal to said central panel, said product receiving apertures being disposed within said distal and middle thirds of said third end panels.

3. The package according to claim 1 further comprising a product which is a self-supporting container received within said product-receiving apertures.

4. The package according to claim 3 wherein said container comprises a plastic bottle.

5. The package according to claim 3 further comprising a further product disposed between said container and said central panel.

6. The package according to claim 5 wherein said further product comprises a plastic mesh.

7. The package according to claim 1 wherein said further product comprises a plastic mesh.

8. The package according to claim 1 further comprising shrink wrap surrounding the package.

9. The package according to claim 8 wherein said shrink wrap together with said self-supporting container maintain each of said first and third end panels generally perpendicular to said central panel and said second end panel generally parallel to said central panel.

10. The package according to claim 1 wherein each said fourth end panel is adhered to said central panel on a side of each said third end panel distal to said first end panel.

11. The package according to claim 1 wherein each said fourth end panel is adhered to said central panel on a side of each said third end panel proximal to said first end panel.

12. The package according to claim 1 further comprising at least one further self-supporting container.

13. The carton according to claim 1 wherein said scorelines separating said end panels from the central panel and from each other are transverse scorelines.

14. The package according to claim 5 wherein said further product comprises a sponge.

15. The package of claim 1 wherein at least one of said product receiving structures defines a compartment as the further product a and said compartment contains plastic mesh.

16. The package of claim 15 wherein said compartment is defined by at least the first, second and third end panels of said at least one product receiving structure and by a portion of said central panel.

17. A package comprising a) a carton including i) a central panel having two ends, ii) product receiving structures at each end, each of said product receiving structures including A) a first end panel separated from said central panel by a first score line, B) a second end panel separated from said first end panel by a second score line, C) a third end panel separated from said second end panel by a scoreline, D) and a fourth end panel separated from said third end panel by a scoreline and adhered to said central panel, E) said third end panels each including a product receiving aperture spaced from said fourth end panels, said package comprising a product which is a self-supporting container received within said product-receiving apertures, said container comprising a plastic bottle, said package further comprising a further product disposed between said container and said central panel, said further product comprising a plastic mesh.

18. The package according to claim 17 wherein said plastic mesh is a pouf.

19. The package according to claim 17 further comprising shrink wrap surrounding the package.

20. The package according to claim 19 wherein said shrink wrap together with said self-supporting container maintain each of said first and third end panels generally perpendicular to said central panel and said second end panel generally parallel to said end panel.

21. The package according to claim 17 further comprising at least one further self-supporting container.

22. The package of claim 17 wherein at least one of said product receiving structures defines a compartment and said compartment contains said plastic mesh.

23. A package comprising a) a carton including i) a central panel having two ends, ii) product receiving structures at each end, each of said product receiving structures including A) a first end panel separated from said central panel by a first score line, B) a second end panel separated from said first end panel by a second score line, C) a third end panel separated from said second end panel by a scoreline, D) and a fourth end panel separated from said third end panel by a scoreline and adhered to said central panel, E) said third end panels each including a product receiving aperture spaced from said fourth end panels, said package comprising a product which is a self-supporting container received within said product-receiving apertures, said container comprising a plastic bottle, said package further comprising a further product disposed between said container and said central panel, said further product comprising a sponge.

* * * * *